US005738288A

United States Patent [19]

Karra

[11] Patent Number: 5,738,288

[45] Date of Patent: Apr. 14, 1998

[54] CONICAL CRUSHER HAVING A SINGLE PIECE INNER CRUSHING MEMBER

[75] Inventor: Vijia Kumar Karra, Franklin, Wis.

[73] Assignee: Nordberg Incorporated, Milwaukee, Wis.

[21] Appl. No.: 658,353

[22] Filed: Jun. 5, 1996

[51] Int. Cl.[6] ..... B02C 2/04

[52] U.S. Cl. ..... 241/207; 241/215; 241/293

[58] Field of Search ..... 241/207, 208, 241/214, 215, 216, 293

[56] References Cited

U.S. PATENT DOCUMENTS

| | | | |
|---|---|---|---|
| 2,148,682 | 2/1939 | Campell | 241/208 |
| 3,118,623 | 1/1964 | Johnson | 241/207 |
| 3,423,033 | 1/1969 | Durand | 241/215 X |
| 3,477,651 | 11/1969 | Decker et al. | 241/293 |
| 4,179,076 | 12/1979 | Barrot et al. | 241/207 X |
| 4,604,781 | 8/1986 | Rankin, III | 241/293 X |
| 4,895,311 | 1/1990 | Arakawa | 241/207 |
| 5,516,053 | 5/1996 | Hannu | 241/207 |
| 5,570,850 | 11/1996 | Kay | 241/207 |

*Primary Examiner*—John M. Husar
*Attorney, Agent, or Firm*—Foley & Lardner

[57] ABSTRACT

A conical crusher having a rigidly supported outer frusto-conically shaped crushing member and an inner conical crushing member supported on a wobble mechanism which is in turn supported by air bellows. The air pressure in the air bellows is regulated to adjust the spacing between the inner and outer crushing members, and therefore the particle size of the crushed material. The inner and outer crushing members are readily replaceable. The inner crushing member serves as a single piece crushing head/mantle attachment.

22 Claims, 4 Drawing Sheets

COMP.

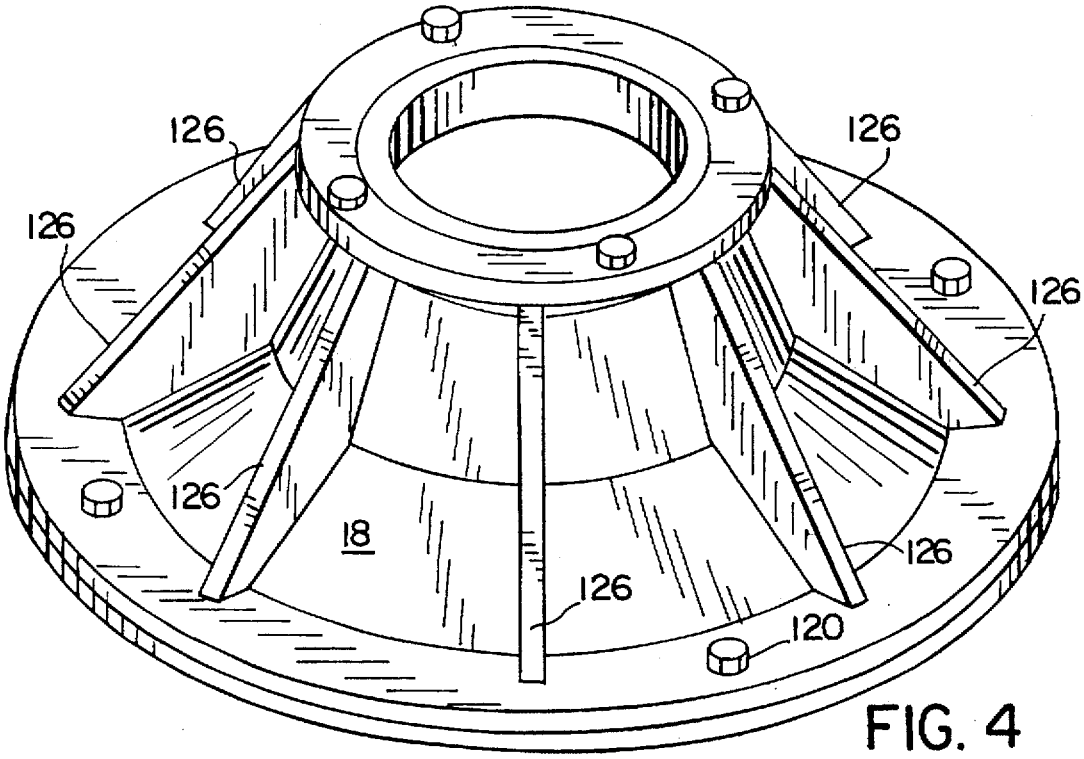
FIG. 4
FIG. 5
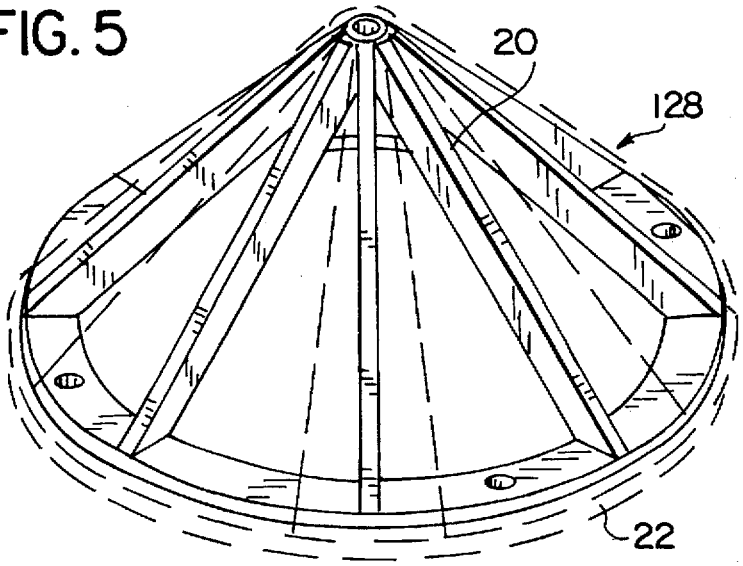

CONICAL CRUSHER HAVING A SINGLE PIECE INNER CRUSHING MEMBER

CROSS REFERENCE TO RELATED APPLICATIONS

The present application is related to U.S. application Ser. No. 08/658,650, entitled "A Conical Crusher Having Fluid Bellow Support Assemblies," now pending and U.S. application Ser. No. 08/658,366, entitled "A Conical Crusher Having a Single Piece Outer Crushing Member," now pending both assigned to the Assignee of the present invention and invented by Karra.

FIELD OF THE INVENTION

The present invention generally relates to a conical crusher. More particularly, the present invention relates to a rock crusher of simplified construction and superior operational efficiency. The rock crusher can be used for size reduction of low strength, easy to crush materials such as rocks and minerals, and for light duty shaping-type crushing operations.

BACKGROUND OF THE INVENTION

Conical crushers having head assemblies which are caused to gyrate by an eccentric mechanism, driven by various rotary power sources, are commonly available and have been the subject of numerous prior patents. A conical crusher typically has an annular shell, and a central hub to which an annular ring is mounted for vertical movement. The crusher bowl and liner are mounted on the annular ring. The head assembly includes a liner which is mounted, for movement through a bearing mechanism, directly to a stationary shaft within the hub. Gyration of the head relative to the bowl assembly is provided by an eccentric mounted for movement about the stationary shaft. With respect to rotation about the shaft., the eccentric is dynamically balanced about its center of rotation by a counter weight. The bowl of the crusher is provided with an upper liner and the head member is provided with a replaceable mantle.

Alternatively, another type of conical crusher can include a shaft which is moved by a hydraulic piston arrangement attached to the bottom end of the shaft. The bowl liner can be fixed to a mechanical adjustment device. In both types of cone crushers, the gap between the bowl liner and crushing head can be manipulated to provide particular sized crushed product. Both of these types of rock crushers have proven most satisfactory in heavy-duty crushing operations, particularly when the coacting crushing surfaces, which are subject to wear, are provided with replaceable liners for extending the life of the crusher.

However, for certain crushing and shaping operations, a less robust crusher, of simpler and lighter weight construction and greater operational efficiency, is desirable. For instance, it is not necessary to use a heavy-duty crusher, such as set forth in the above-mentioned patents, for low strength, easy to crush rocks and minerals such as coal and non-metallic minerals, and for light duty shaping type crushing applications. Thus, there is a need for a rock crusher which does not utilize massive support structures. Further, there is an economic need for a light duty crusher which can be easily adjusted for crushing various sizes of crushed materials. There is further a need for a light duty crusher which only requires a one piece mantle/crushing head or inner crushing member.

SUMMARY OF THE INVENTION

The present invention relates to a crusher mounted on a foundation. The crusher includes a main support member for securing to the foundation, a bottom plate fixed to the main support member, a one piece, generally conically shaped, downwardly spreading, inner crushing member supported on said bottom plate, and a generally frustoconically shaped, downwardly spreading, outer crushing member supported on said main support member in a spaced relationship to said conically shaped inner crushing member. The inner and outer crushing members are spaced apart so that material passing between the inner crushing member and the outer crushing member is crushed.

The present invention additionally relates to a single piece inner crushing member for use in a crusher including a wobble mechanism, a plate, a support member, and a generally conically shaped outer crushing member. The outer crushing member is supported by the main support member. The main support member includes an outer rim, the wobble mechanism is located within the outer rim of the main support member and provides a wobble motion with respect to the main support member and the outer crushing member. The plate is secured to the wobble mechanism and receives the wobble motion. Material is fed between the outer crushing member and the inner crushing member to be crushed. The single piece inner crushing member includes a generally conically shaped, downwardly spreading, outer crushing wall. The wall has a top end and a bottom end. The bottom end of the wall is configured for engagement with the plate.

The present invention still further relates to a crusher mounted on a foundation. The crusher includes a main support member, a wobble mechanism, a single piece conically shaped, downwardly spreading, inner crushing member, and a single piece frustoconically shaped outer crushing member. The main support member has at least one aperture. The wobble mechanism is disposed within the aperture. The inner crushing member is coupled to the wobble mechanism and supported by the main support member. The inner crushing member has an inside surface and an outside surface. The outside surface is a crushing surface of the crusher.

In one exemplary aspect of the present invention, a single piece inner crushing member is mounted on a plate within an aperture of a mainframe. The single piece inner Crushing member serves as a crushing head/mantle and includes interior and exterior surfaces. The exterior surface serves as a crushing surface, and the interior surface generally surrounds a rod which is fixed to a plate. The bottom end of the inner crushing member is configured to receive the plate.

The present invention still further relates to a conically shaped downwardly spreading inner crushing member which is supported upon a bottom plate which is secured to the top surface of the upper member of the wobble mechanism. A frustoconically shaped downwardly spreading outer crushing member is a single piece and is supported in a fixed position surrounding the inner crushing member. The wobble mechanism, and therefor the inner crushing member, is supported so as to be vertically adjustable with respect to the base of the crusher. By adjusting the vertical position of the inner crushing member, its position with respect to the outer crushing member is adjusted. In a preferred embodiment, the inner crushing member is adjustably supported on the base of the crusher by an air bellows assembly. By regulating the air pressure in the air bellows, the relative height of the inner crushing member with respect to the base of the crusher may be adjusted.

BRIEF DESCRIPTION OF THE DRAWINGS

FIG. 4 is a perspective view of an alternative embodiment of the outer crushing member of the conical crusher shown in FIG. 1, which is provided with a support rib cage; and FIG. 5 is a perspective view of a support rib cage for the inner crushing member of the conical crusher shown in FIG. 1.

DETAILED DESCRIPTION OF THE PREFERRED EMBODIMENT

Figure 1:
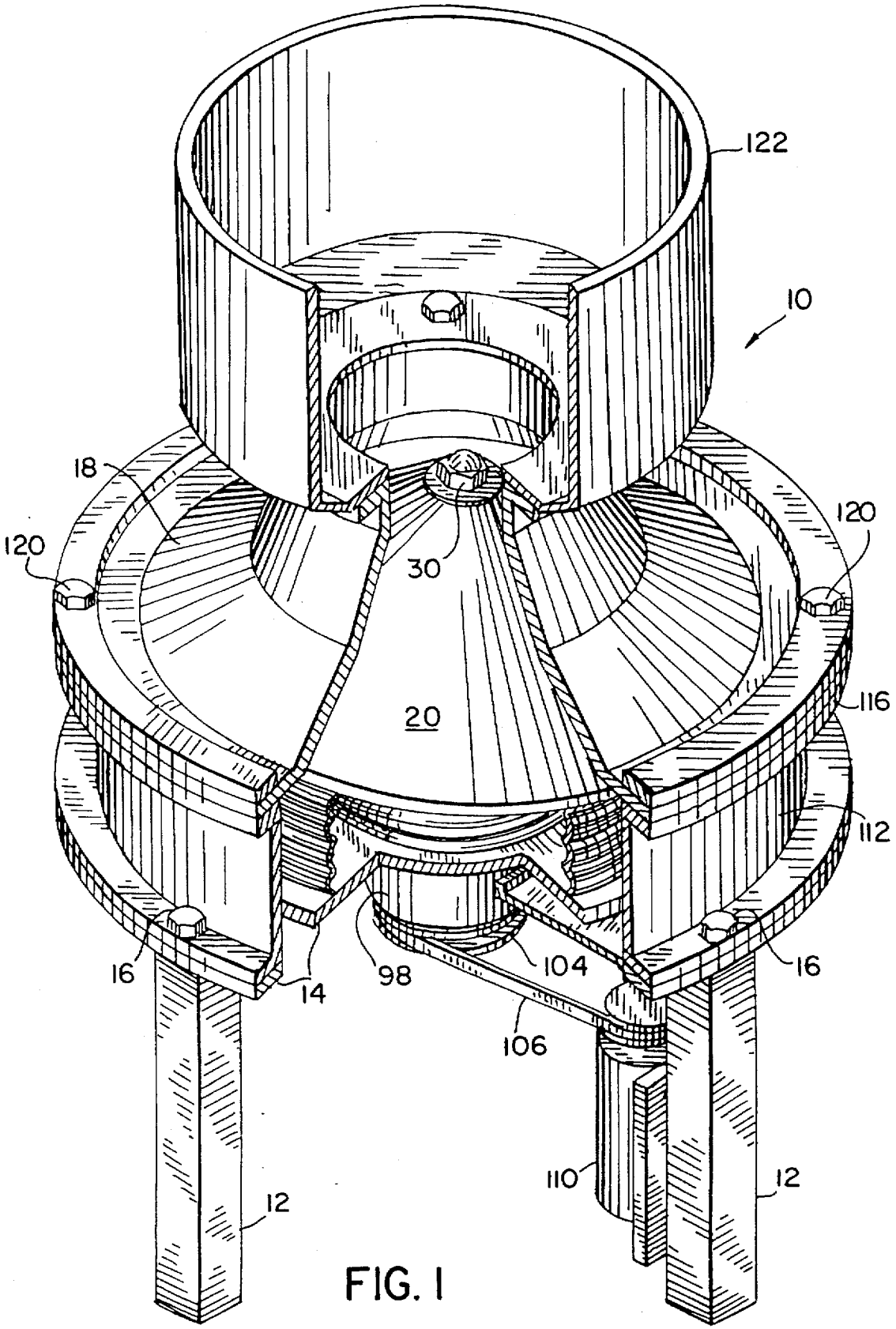
FIG. 1 is a perspective view of a conical crusher constructed in accordance with this invention.
Figures 2, 2A:
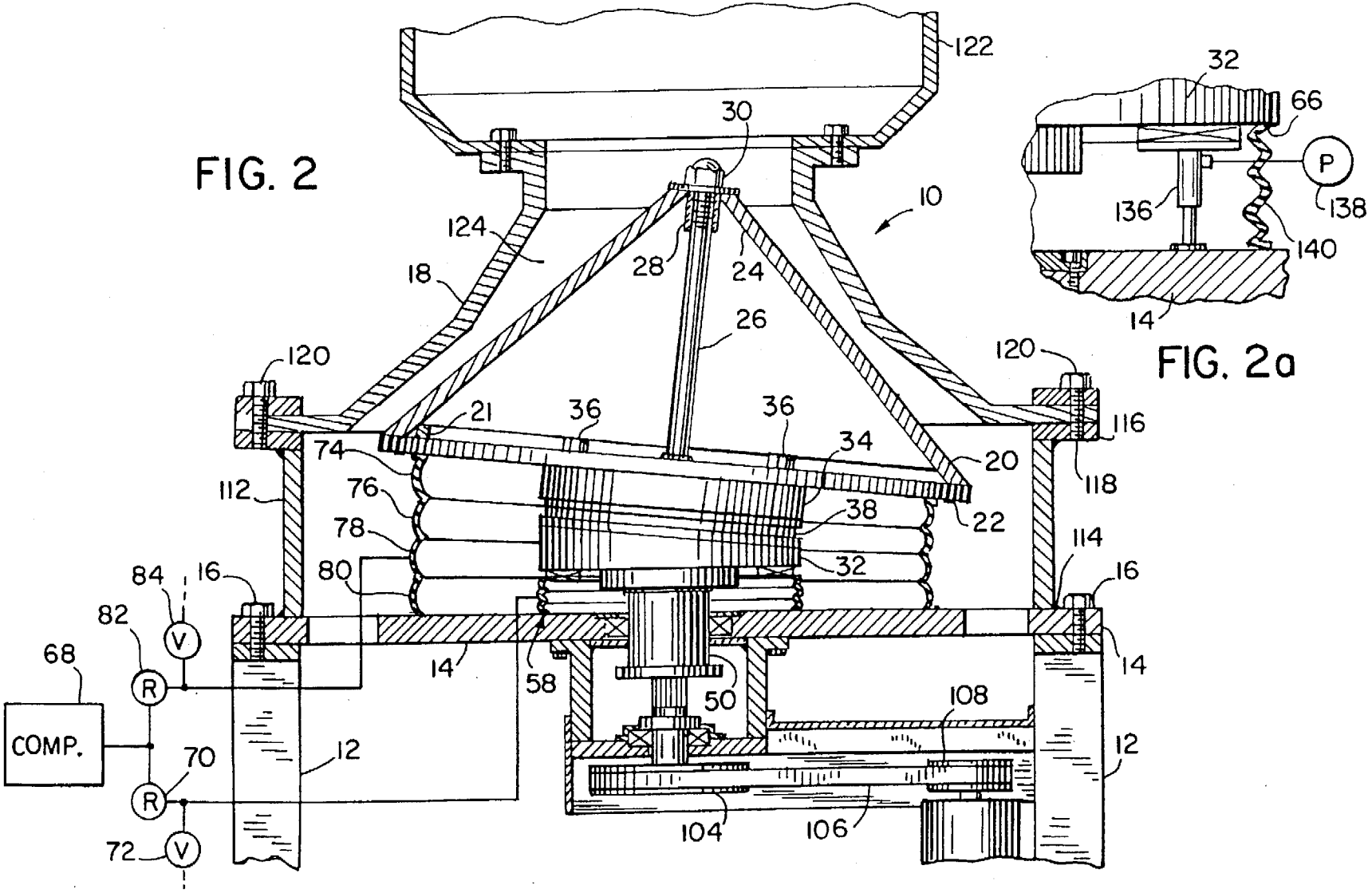
FIG. 2 is a cross-sectional view of the conical crusher of this invention as shown in FIG. 1.
FIG. 2*a* is a partial cross-sectional view of an alternate construction for a portion of the conical crusher as shown in FIG. 2.

Referring to FIGS. 1 and 2, a crushing system or conical crusher 10 in accordance with an exemplary embodiment of the present invention is shown supported on foundation pillars 12. The crusher is assembled on a main support member or bottom plate 14. The bottom plate 14 is secured to the foundation pillars 12 by anchoring means such as bolts 16. While the crusher is shown supported on pillars 12, it may be supported in any other suitable manner, such as on a cylindrical base having opening therein for removal of the crushed material and servicing of the crusher.

The crusher includes a frustoconically shaped downwardly spreading outer crushing member 18 and a conically shaped downwardly spreading inner crushing member 20. The inner crushing member 20, which is commonly referred to as a mantle, is supported along its lower edge on a bottom or a base plate 22. Base plate 22 can include a retaining member or retaining ring 21 to help secure member 20. A hole 24 is provided in the apex of the inner crushing member 20 through which passes a securing device 26 in the form of a rod which is secured at its lower end to the base plate 22 and is provided with a threaded portion 28 at its upper end. A fastener 30, in the form of a nut, engages the threaded portion 28 and presses on the top edge of the inner crushing member 20 to secure it to the base plate 22. Fastener 30 can be protected by a suitable wearing member disposed over it.

Figure 3:
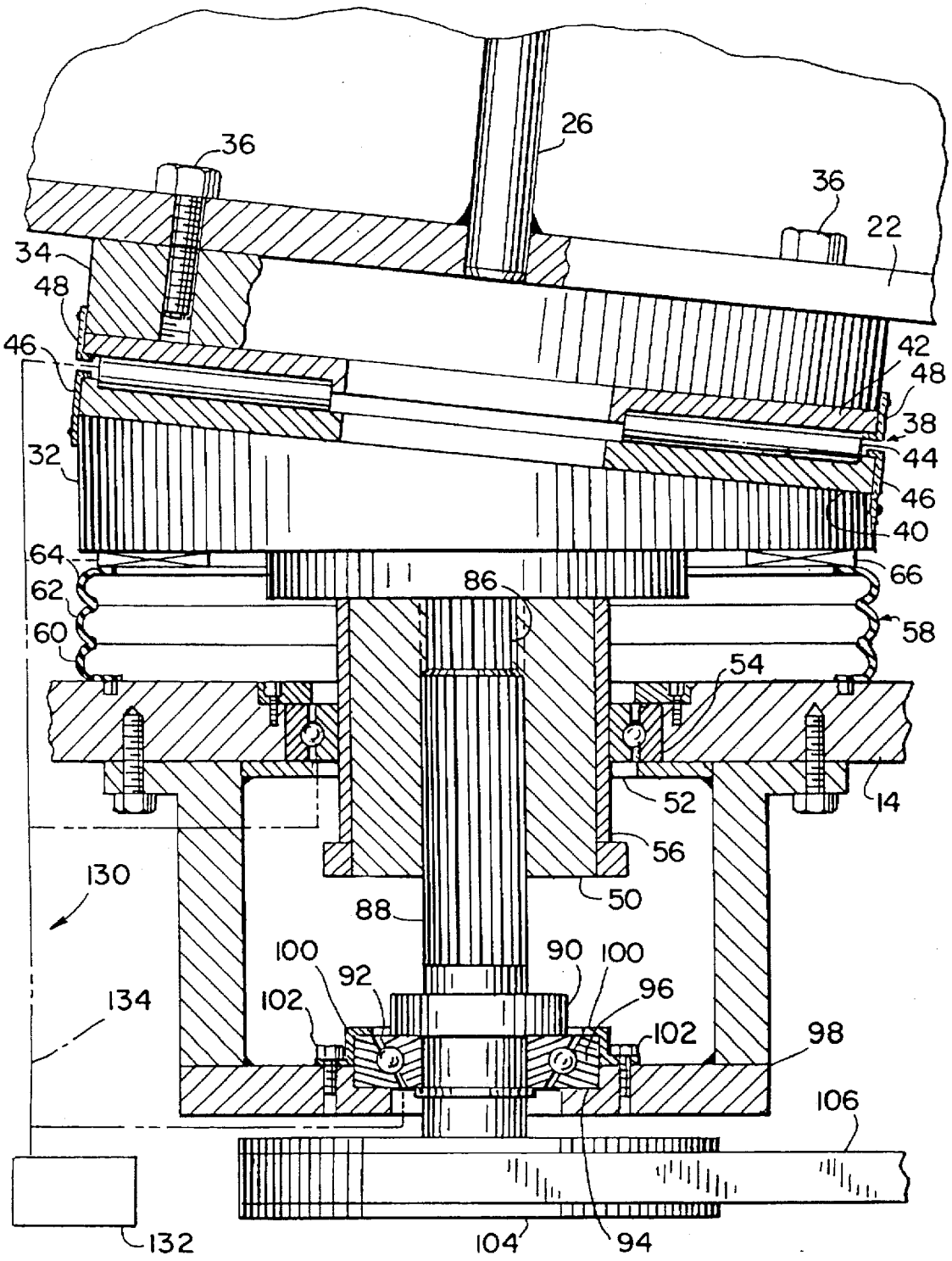
FIG. 3 is an enlarged cross-sectional view of the support and drive mechanism for the inner crushing member of the conical crusher of this invention as shown in FIG. 1.

Referring to FIGS. 2 and 3, the conically shaped inner crushing member 20 is supported on a wobble mechanism which includes a lower cylindrical member 32 and an upper cylindrical member 34. The upper cylindrical member 34 is secured to the base plate 22 by a fastener such as bolts 36. A bearing arrangement 38, shown as radially extending roller bearings, is interposed between the upper surface of lower member 32 and the lower surface of upper member 34 to permit the upper and lower member to rotate with respect to each other. Alternatively, bearing arrangement 38 can be a plurality of vertically disposed rollers located at an outer edge of members 32 and 34. Further still, bearing arrangement 38 can be a vertically disposed sleeve bearing system or a horizontally disposed thrust bearing system.

As shown in FIG. 3, the bearing assembly 38 includes a lower bearing race 40, an upper bearing race 42, and rollers 44. The lower bearing race 40 is secured to lower member 32 by clamps 46, and the upper bearing race 42 is secured to upper member 34 by clamps 48. The lower member 32 is secured to and supported on the upper end of a shaft 50 for rotation therewith. Generally, any mechanism can be used to rotate, gyrate, move or wobble inner crushing member 20 including, but not limited to an eccentric mechanism (not shown). The upper surface of the lower member 32 is in a plane which is not perpendicular to the central axis of the shaft 50. Thus, as the shaft 50 rotates, the upper member 34, which is prevented from rotating, as will hereinafter be described, is caused to wobble as alternately a higher and a lower portion of the upper surface of the lower member 32 passes under a fixed location on the upper member 34. The upper surface of the lower member 32 may be located in a plane which is not perpendicular to the central axis of the shaft 50 by forming the lower member 32 as a wedge shaped member, or by welding a uniformly thick lower member 32 to the end of the shaft 50 which has been cut in a plane which is not perpendicular to its central axis.

The shaft 50 passes through an aperture 52 formed in the bottom plate 14 and is supported for rotation therein by a bearing 54. The shaft 50 is surrounded by a cylindrical sleeve 56 which slides vertically with respect to the inner race of the bearing 54. The sleeve 56, which is secured to shaft 50, is formed of a material which will reduce the sliding friction between the inner race of the bearing 54 and shaft 50. The shaft 50, lower member 32 and upper member 34 of the wobble mechanism, as Well as the inner crushing member 20, are supported on the bottom plate 14 by a fluid bellow assembly such as air bellow assembly 58 which is illustrated as three ring shaped bellows stacked one on top of the other. The bellows 60, 62 and 64 are secured to each other, and the lower surface of the lower bellow 60 is secured to the bottom plate 14 by securing devices such as pins. A ring like bearing assembly 66 is interposed between the top surface of the bellow 64 and the lower surface of the lower member 32. While not shown in detail, ring-like bearing assembly 66 could be similar in construction to bearing 38, with an upper bearing race secured to the lower surface of lower member 32, and a lower bearing race secured to the top of bellow 64. Bearing 66 can be a horizontally or vertically disposed sleeve bearing, roller bearing or thrust bearing.

The height of the lower member 32 with respect to the bottom plate 14 is adjusted by regulating the air pressure in the ring shaped bellows 60, 62 and 64. As shown in FIG. 2, air may be supplied from a compressor 68 through a regulator 70 to the bellows 60, 62 and 64. Should it be desirable to reduce the air pressure in bellows 60, 62, and 64, air may be discharged through valve 72.

The inner crushing member 20 is prevented from rotating by a fluid bellow assembly shown as a stack of air bellows 74, 76, 78 and 80. The bellows are secured to each other, and the upper surface of bellow 74 is secured to base plate 22 and the lower surface of lower bellow 80 is secured to the bottom plate 14. As in the case of the bellows 60, 62 and 64, a regulated supply of air is provided to the bellows 74, 76, 78 and 80 from air compressor 68 through a regulator 82. The regulated air pressure supplied to the bellows 74, 76, 78, and 80 is such that it permits wobbling of the base plate 22, and does not tend to lift the base plate 22, such that it would not be fully supported by the bellows 60, 62 and 64. Should it be desirable to reduce the air pressure in bellows 74, 76, 78, and 80, air may be discharged through valve 84. Not only do the bellows 74, 76, 78, and 80 prevent the inner crushing member 20 from turning, but they also provide a seal to prevent crushed material, and dust therefrom, from reaching the bearings 38 and 66. Similarly, air bellow assembly 58 further prevents the crushed material and dust from reaching the upper surface of bearing 54.

The shaft 50 is provided with a splinted bore 86 which receives an externally splined shaft 88. The shaft 88 is held in a fixed vertical position by an increased diameter portion 90, the lower edge of which rests on the inner race 92 of a bearing assembly 94. Outer race 96, of the bearing assembly 94, is secured to a support bracket 98 by clamps 100 and fasteners 102. Attached to the lower end of the shaft 88 is a pulley 104. The pulley 104 is driven by a belt 106 which engages a pulley 108 driven by a prime mover 110, such as an electric motor. While a pulley and belt drive system is shown, other types of drive systems could be used, such as a hydraulic drive or a conventional gear and pinion shaft drive. Bearing assembly 94 can also be a horizontally or vertically disposed roller, sleeve or thrust bearing system.

The outer crushing member 18 is supported from the bottom plate 14 by a cylindrical wall member 112 which is welded at its lower end 114 to the bottom plate 14 and is provided with a flange 116 at the top. The flange 116 is provided with apertures 118 therein, located to coincide with apertures formed in the outer crushing member 18, to receive bolts such as 120 to secure the outer crushing member 18 to the cylindrical wall 112.

Turning to the operation of the crusher, material to be crushed is deposited in a hopper 122 through which it enters into a conical gap 124 between the outer crushing member 18 and the inner crushing member 20. As the inner crushing member 20 wobbles within the outer crushing member 18, the material falls in the area where the crushing members are more widely spaced and is thereafter crushed as the inner and outer members move together. By increasing the air pressure in bellows 60, 62, and 64, the inner crushing member 20 may be raised, moving its outer surface closer to the outer crushing member 18, thereby resulting in finer crushing of the material being crushed.

While in heavier duty crushers such as those set forth in the above-mentioned patents, replaceable wear members, usually called liners, are provided on the inner and outer crushing parts, in the conical crusher of this invention, the replaceable wear liners are not provided. However, members 18 and 20 can be replaced when worn. Rather, the inner crushing member 20 or mantle and the outer or upper crushing member 18 are formed of a suitable wear resistant material. Suitable materials for particular applications are manganese, air quenched and tempered chromium steel, and a low cost steel with wear resistant studs provided on the crushing surface. While the inner crushing member or mantle 20 and the outer crushing member 18 may be made of suitable wear resistant material, their strength may not be sufficient to prevent deformation in certain applications. To prevent deformation, the outer crushing member 18 may be provided with ribs. Or, a separate rib cage including ribs 126 (shown in FIG. 4) may be provided and can be secured over the outer crushing member 18. Similarly, a rib cage 128, as shown in FIG. 5, may be provided to fit under the mantle or inner crushing member 20 shown in dashed lines so as to reinforce it.

System parameters and design criteria can affect the size and shape of inner crushing member 20. Crushing member 20 can have generally parallel interior and exterior surfaces. The exterior surface of member 20 advantageously serves as crushing surface for crusher 10. Member 20 can have various steps, angled surfaces or other formations and still be considered generally conical and to have generally parallel surfaces.

Referring to FIG. 2*a*, in an alternate embodiment of this invention the air bellow assembly 58 supporting the inner crushing member 20 on the bottom plate 14 is replaced by several hydraulic cylinders, one of which 136 is shown. Hydraulic pressure is supplied to the cylinders by a pump 138. To provide the bearing 54 with the same protection from crushed material and dust as is provided by the bellow assembly 58, a flexible cylindrical wall 140 is secured to the bottom surface of lower cylindrical member 32 and bottom plate 14.

Bellow assembly 58 and air bellows 74, 76, 78, and 80 can be replaced by other support devices. System parameters and design criteria can affect the embodiment of either support device. For example, the support device between base plate 22 and bottom plate 14 preferably provides sufficient force to counteract crushing forces and yet does not substantially lift plate 22 with respect to plate 14. The support device allows wobbling of inner crushing member 20 and yet prevents inner crushing member 20 from turning. The support device preferably also seals bearing 38 from the crushed material in crusher 10. The support device can be a spring assembly, a cable tension assembly, a piston assembly, or other apparatus for providing an appropriate level of tension and force between member 20 and bottom plate 14.

To prolong the life of the bearings 38, 54, 66, and 94, a lubrication system 130 is provided whereby lubrication may be supplied to the bearings while the crusher is in operation. The lubrication system includes a pressurized source of lubricant 132, and a piping system 134 connecting each of the bearings to the source 132.

When comparing a conical crusher constructed in accordance with this invention as set forth above, with those shown in the prior art patents set forth above, it will be noted that the following advantages are offered:

1. Fewer parts.
2. Simplified manufacturing and fabrication.
3. Lower cost.
4. Increase energy efficiency.
5. Will operate with the material to be crushed being either wet or dry.
6. Lower operating cost per ton of product crushed.
7. Better quality control of the ground product through the ready adjustment provided by the bellows support system for the inner crushing member.
8. Ease of operation, maintenance and repair.

For instance, while replaceable liners are not provided, worn inner and outer crushing members can be readily replaced wherein they are attached to the crusher by readily engageable and disengageable fastening means shown as nuts and bolts.

It should be noted that if tramp material becomes wedged between the inner and outer grinding members, the air pressure in the bellows supporting the inner grinding member may be reduced, thereby permitting the inner grinding member to drop away from the outer grinding member so as to free the tramp material from between the grinding surfaces. Since the crushing gap between the inner and outer members is readily adjusted and controlled by the bellows support system, the particle size of the crushed material may be readily adjusted.

While one embodiment, and component variations of the invention have been shown, it should be apparent to those skilled in the art that what has been described is considered at present to be a preferred embodiment of the conical crusher of this invention. In accordance with the Patent Statute, changes may be made in the conical crusher without actually departing from the true spirit and scope of this invention. The appended claims are intended to cover all such changes and modification which fall in the true spirit and scope of this invention.

What is claimed is:

1. A crusher comprising:

a main support member ;

a crusher head including a generally planar base plate and a one piece, generally conically shaped, downwardly spreading, inner crushing member having a bottom supported by said base plate, said crusher head being movably supported with respect to said main support member; and a generally frustoconically shaped, downwardly spreading, outer crushing member supported on said main support member in a spaced relationship to said conically shaped crushing member such that material passing between said inner crushing member and said outer crushing member is crushed.

2. The crusher of claim 1, wherein said one piece inner crushing member has a lower peripheral edge, and a hole at its apex, said lower peripheral edge engaging and supported on said base plate, said inner crushing member having a securing device extending from said base plate passing through said hole, and a fastener engaging said securing device and said inner crushing member at its apex to secure said one piece crushing member to said base plate.

3. The crusher of claim 2, wherein said securing device includes a threaded portion, and said fastener is a nut which engages said threaded portion.

4. The crusher of claim 1, wherein said wear resistant composite material is ceramic.

5. The crusher of claim 1, wherein said one piece inner crushing member is formed of a wear resistant composite material.

6. The crusher of claim 1, wherein said one piece inner crushing member is formed of manganese.

7. The crusher of claim 1, wherein said one piece inner crushing member is formed of air quenched and tempered chromium steel.

8. The crusher of claim 1, wherein said base plate includes a retaining member disposed about a circumference of said base plate.

9. The crusher of claim 1, wherein a conically shaped, downwardly spreading rib cage is fastened on said base plate, and said conically shaped, downwardly spreading, inner crushing member is placed over said rib cage to be supported thereby.

10. A single piece inner crushing member for use in a crusher including a wobble mechanism, a securing device, a generally planar plate having a periphery, a main support member and a generally conically shaped outer crushing member supported by the main support member, the main support member including an outer rim, the wobble mechanism being located within the outer rim of the main support member and providing a wobbling motion with respect to the main support member and said outer crushing member, the plate being secured to the wobble mechanism and receiving the wobble motion, whereby material is fed between the outer crushing member and the inner crushing member to be crushed, the single piece inner crushing member comprising:

a generally conically shaped, downwardly spreading, outer crushing wall, the wall having a top end and a bottom end; and wherein said bottom end of said wall being configured for engagement with the periphery of the plate and said top end being configured to interface with the securing device.

11. The crushing member of claim 10, wherein said top end includes an aperture configured to receive a support rod, the support rod being the securing device.

12. The crushing member of claim 11 wherein said support rod is fixed to the plate.

13. The crushing member of claim 12 wherein the support rod is fixed to said top end at said aperture.

14. The crushing member of claim 12 wherein a plurality of bolts are disposed through the plate to the wobble mechanism.

15. The crushing member of claim 14, wherein said one piece inner crushing member is formed of manganese.

16. The crushing member of claim 10 wherein a fluid bellow assembly couples the plate to the main support member.

17. The crushing member of claim 16 wherein the circumference member is substantially the same as the circumference of the plate.

18. The crushing member of claim 17 wherein the rod has a threaded end disposed through said aperture.

19. A crusher comprising:

a main support member having at least one aperture therein, a wobble mechanism disposed within said one aperture;

an outer crushing member coupled to the main support member; and a generally hollow crusher head including a generally planar base plate and a single piece conically shaped, downwardly spreading, inner crushing member, said crusher head being coupled to said wobble mechanism, said inner crushing member having a bottom supported by said base plate and having an inside surface and an outside surface, said outside surface being a crushing surface of said crusher.

20. The crusher of claim 19 further comprising a support cage disposed under said inner crushing member.

21. A crusher comprising:

a main support member for securing to a foundation;

a one piece, generally conically shaped, downwardly spreading, inner crushing member movably supported with respect to said main support member;

a generally frustoconically shaped, downwardly spreading, outer crushing member supported on said main support member in a spaced relationship to said conically shaped crushing member such that material passing between said inner crushing member and said outer crushing member is crushed; and a conically shaped, downwardly spreading rib cage fastened on said base plate, and said conically shaped, downwardly spreading, inner crushing member being placed over said rib cage to be supported thereby.

22. A crusher comprising:

a main support member having at least one aperture therein, a wobble mechanism disposed within said at least one aperture;

an outer crushing member coupled to the main support member;

a single piece conically shaped, downwardly spreading, inner crushing member coupled to said wobble mechanism and supported by said main support member, said inner crushing member having an inside surface and an outside surface, said outside surface being a crushing surface of said crusher, and a support cage disposed under said inner crushing member.

* * * * *